United States Patent [19]

Gailey

[11] 4,356,673

[45] Nov. 2, 1982

[54] SIDING PANEL SYSTEMS AND METHODS OF INSTALLATION

[75] Inventor: J. Lynn Gailey, Newton Falls, Ohio

[73] Assignee: Alcan Aluminum Corporation, Cleveland, Ohio

[21] Appl. No.: 177,358

[22] Filed: Aug. 11, 1980

[51] Int. Cl.[3] ..... E04G 23/00; E04D 1/34; E04D 3/362

[52] U.S. Cl. ..... 52/127.1; 52/79.9; 52/514; 52/520; 52/531; 52/545; 52/748

[58] Field of Search ..... 52/52, 514, 531, 545, 52/748, 520, 79.9, 127, 749

[56] References Cited

U.S. PATENT DOCUMENTS

| | | | |
|---|---|---|---|
| 1,121,365 | 12/1914 | Hull | 52/514 |
| 2,173,774 | 9/1939 | Birch et al. | 52/531 X |
| 2,293,744 | 8/1942 | Miles et al. | 52/748 X |
| 3,325,952 | 6/1967 | Trachtenberg | 52/514 X |
| 3,347,009 | 10/1967 | Meddick | 52/545 |
| 4,187,661 | 2/1980 | Poiry | 52/748 |

*Primary Examiner*—Alfred C. Perham
*Attorney, Agent, or Firm*—Cooper, Dunham, Clark, Griffin & Moran

[57] ABSTRACT

For use with horizontal siding panels each having complementary first and second locking means respectively formed along their top and bottom margins for interlocking vertically adjacent courses of panels in overlapping array, a system and method for mounting, on a wall, a panel interposed between already-mounted upper and lower courses which are vertically spaced by a distance less than the height of the interposed panel. The system includes clip means for securing the second locking means of the upper-course panels to the wall while permitting upward insertion of the first locking means of the interposed panel, behind the upper-course panels, to a level above that at which the second locking means of the upper-course panels would interlock therewith, and retaining means for securing the first locking means of the interposed panel to the wall at that level. The method includes the steps of inserting the first locking means of the interposed panel upwardly behind the upper-course panels to the aforementioned level and there engaging the first locking means of the interposed panel with the retaining means while securing the second locking means of the interposed panel to the wall by interlocking with wall-mounted structure, e.g. with the first locking means of a lower-course panel.

15 Claims, 9 Drawing Figures

Fig. 1.
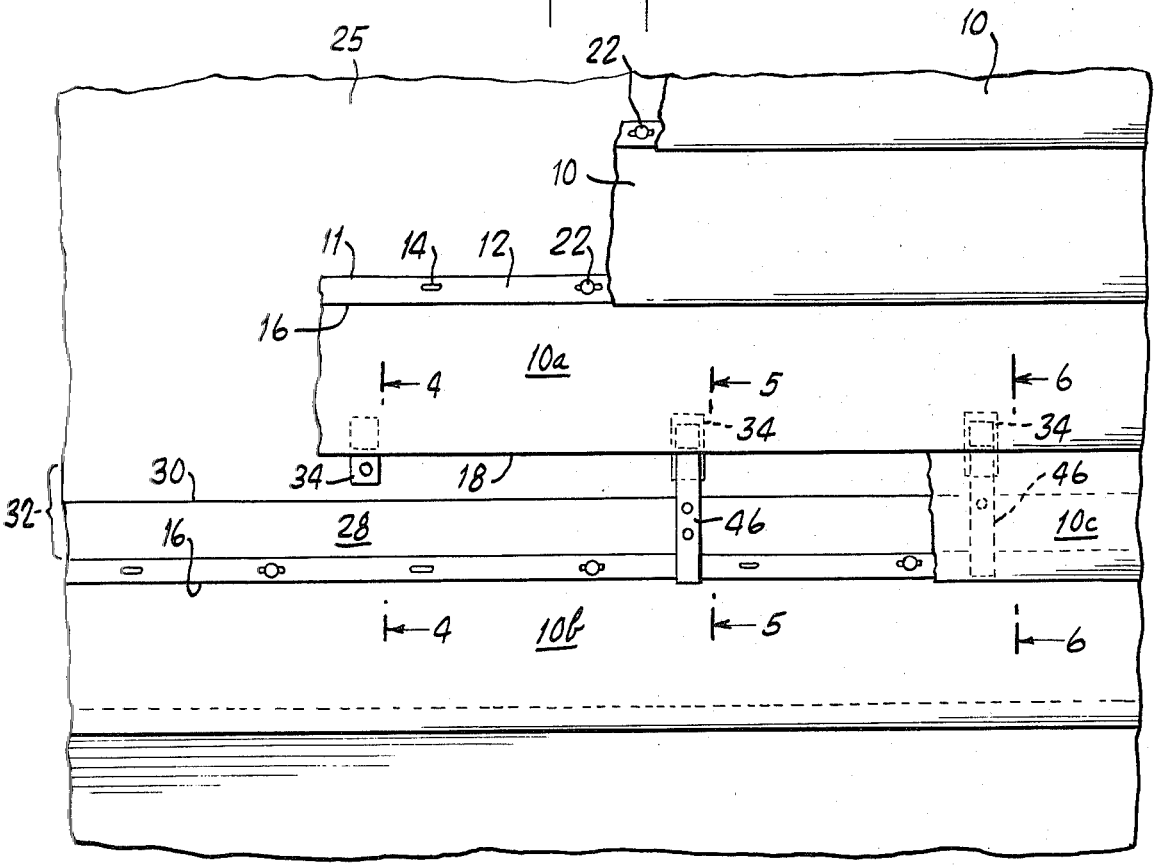
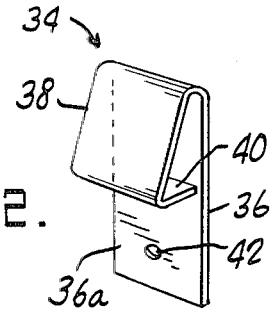
Fig. 2.
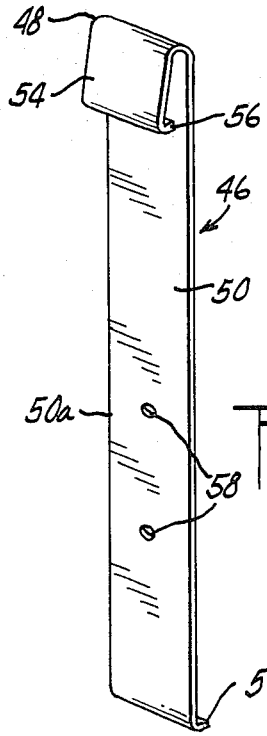
Fig. 3.

25
26
28
48
16
50
22
10a
11
54
56
40
20
60
10c
46
52
10b
36
44
34
38
18
31
32
12
24
33

SIDING PANEL SYSTEMS AND METHODS OF INSTALLATION

BACKGROUND OF THE INVENTION

This invention relates to siding panel systems and methods of installing them on a wall or the like, and more particularly to systems and methods for mounting a horizontal siding panel between and in lapped relation to vertically spaced upper and lower courses of such panels already mounted on a wall. In an important specific aspect, the invention is directed to methods and systems for mounting a horizontal siding panel at the joint between upper and lower panel-clad prefabricated wall sections.

Horizontally elongated siding panels made of roll-formed sheet metal or molded plastic are widely employed for cladding exterior building walls. Typically, they are mounted in parallel, overlapping, interlocked relation on a wall with their surfaces sloping downwardly and outwardly to simulate the appearance of wooden clapboards or rows of shingles. Each panel is attached at its top margin to the wall by suitable fasteners, such as nails driven through a flat nailing flange portion of the panel top margin. A first locking means (e.g. an outwardly projecting lip) is formed on each panel adjacent the top margin and below the nailing flange; a second locking means (e.g. an inwardly projecting, upwardly opening channel flange), formed at the bottom margin of each panel, overlies and interlocks with the first locking means or lip of the next lower panel on the wall to secure the panel bottom margin to the wall and to conceal the fasteners that hold the lower panel.

In conventional installation of such panels, the bottom flanges of the panels of the lowermost course to be installed on a wall are first interlocked with a starter strip previously mounted along the lower edge of the wall, and the top margins of these lowermost panels are nailed to the wall. The bottom flanges of the panels of the second (next higher) course are then interlocked with the lips of the panels of the lowest course, and the top margins of the second-course panels are nailed to the wall. Thereafter, progressively higher courses of the panels are installed in succession in like manner one above another, until the wall is fully clad with a continuous array of the panels, each held along its top margin by nails and along its bottom margin by interlocking engagement with the adjacent lower course of panels so as to be fully secured against dislodgement.

It would sometimes be desirable to interpose a panel or a course of panels in a gap or space between previously installed upper and lower courses, i.e. at a location which is below as well as above already-mounted courses of panels. Unless the already mounted upper and lower courses are precisely spaced a proper distance apart, however, it is not possible to interlock both the first and second locking means of the interposed panel with the second locking means of the upper panel and the first locking means of the lower panel, respectively, because the tolerances for such spacing (to achieve the requisite interlocking at both the top and bottom of the interposed panel) are very small. Attainment of requisitely precise spacing is extremely difficult. In addition, since for proper overlapping and interlocking the top margin of the interposed panel must be inserted behind the bottom margin of the already-mounted upper panel, it is in general virtually impossible to fasten the top margin of the interposed panel to the wall, as necessary to secure both the interposed panel and the bottom margin of the upper panel. Consequently, the secure and stable installation of a panel interposed between vertically spaced courses of already-mounted panels has heretofore presented serious problems.

One commercially important situation in which the foregoing problems arise is in the use of siding panels on prefabricated buildings, wherein exterior walls (e.g. frame walls constituted of wooden studs, and having sheathing, doors, windows, etc.) as well as other components are produced in a more or less finished condition by a manufacturer and transported to a construction site for assembly. Since it is frequently difficult or impossible to transport a building wall (especially a wall more than one story high) as a single integral unit, prefabricatd exterior walls are commonly made in two or more sections which are assembled one above another at the construction site. Installation of siding panels on prefabricated walls by the manufacturer is often considered desirable, to reduce labor costs in the field, to control the amount of siding used, and to expedite final assembly of the building; but in the case of walls prefabricated in upper and lower sections having siding panels installed by the manufacturer, there is a discontinuity on the assembled wall between the arrays of panels respectively mounted on the upper and lower wall sections.

That is to say, it is not feasible to dispose the top course of panels on the lower wall section and the bottom course of panels on the upper wall section so that they will interlock properly, or to effect such interlocking when the sections are assembled. Ordinarily, then, it is necessary to leave a gap (i.e. at the juncture of the wall sections) between the upper and lower panel arrays; and indeed, since the height of the lower wall section is usually not equal to the height of an intergral number of courses of siding panels, such a gap is practically unavoidable. In such instances, it would be extremely difficult to so locate a bottom course of panels on the upper wall section that the height of this gap will equal the height of one course of panels, within proper dimensional tolerances for conventionally interlocking a course of panels between the upper and lower arrays. Moreover, even if the panels could be so disposed, it would not be feasible to properly secure the top margin of the course of panels thus interposed between the arrays.

For these reasons, in assembling upper and lower prefabricated wall sections having pre-installed siding panels, resort has heretofore been had to makeshift expedients such as the use of wooden trim boards to bridge the gap between the arrays of siding on the respective sections. These expedients are unsatisfactory both from the standpoint of appearance and because they detract from the protection and durability afforded by a continuous interlocked array of siding panels of the described type.

SUMMARY OF THE INVENTION

The present invention broadly embraces the provision of new and improved systems and methods for mounting a course of siding panels (having the aforementioned first and second locking means) between and in lapped relation to vertically spaced upper and lower courses of similar panels pre-installed on a wall, such that each course of the panels is attached along both the top and the bottom margins with security comparable to that of wholly conventionally installed panels, and the finally assembled courses of panels present the appearance of a continuous overlapping panel array. An illustrative example of use of the invention is in the joining of arrays of panels respectively pre-installed on upper and lower prefabricated wall sections, i.e. to cover the joint between the sections.

For the practice of the invention, it is essential that the height (vertical extent) of the gap between the upper and lower courses of pre-installed panels be less than the panel height of the course of panels that is to be interposed between them. A suitable gap height is relatively easy to achieve, since the invention does not require the close dimensional tolerances that would be necessary if the panels were to be interlocked in conventional manner, but accommodates a substantial range of gap heights for any given panel height. It will be understood that the term "panel height" as used herein refers to the vertical distance between the first and second locking means of a panel, while the term "gap" refers to the distance between the second locking means of the upper course and the first locking means of the lower course of panels; also, that the term "course of panels" embraces one panel or plural panels at a common elevation. For convenience, the course of panels to be installed between the upper and lower courses mentioned above will be referred to herein as the interposed panel course.

In a broad sense, the system of the invention includes the combination of clip means fixedly mountable on a wall for interlocking with the second locking means of a panel of the upper course to secure the bottom margin of the upper-course panel to the wall, and retaining means securable to the wall and having a portion for engaging the first locking means of a panel of the interposed course, at a location behind the upper-course panel and above the elevation at which the first locking means of the interposed panel would conventionally interlock with the second locking means of the upper course panel, to hold the first locking means of the interposed panel against downward movement below the aforementioned location and to secure the top margin of the interposed panel fixedly to the wall, with both the clip means and the retaining means concealed behind the upper-course and interposed panels, the clip means being shaped and dimensioned to accommodate insertion of the top margin of the interposed panel upwardly behind the bottom margin of the upper-course panel (i.e. after the clip means is mounted on the wall and the upper-course panel is interlocked therewith) at least to an extent sufficient to position the first locking means of the interposed panel at the aforementioned location.

It will be understood that, given the gap height defined above between the upper and lower courses, the aforementioned location can be so chosen that when the first locking means of the interposed panel is at that location, the bottom margin of the interposed panel (with the second locking means thereof) overlaps the top margin and first locking means of the lower course of panels. A complete panel assembly incorporating the described system of the invention also includes means for interlocking with the second locking means of the interposed panel to secure the bottom margin of the interposed panel to the wall in such overlapping relation to the lower-course panels, the interlocking means being concealed behind the interposed panel; for example, this interlocking means can be the first locking means of a panel of the lower course. In such cases, the retaining means may, in specific embodiments, further include means for positioning its engaging portion at a height, above the first locking means of the lower-course panel, equal to the panel height of the interposed panel course. The retaining means and/or the interlocking means are arranged to prevent upward movement of the interposed panel after installation.

The method of the invention, for mounting an interposed panel between upper and lower courses as described above, broadly includes the steps of inserting the top margin of the interposed panel upwardly behind the bottom margin of the already-installed upper panel course until the first locking means of the interposed panel reaches a predetermined elevation higher than that at which it would interlock with the second locking means of the upper course of panels, fixedly securing the interposed panel to the wall at that elevation by engagement of the first locking means thereof with a retainer structure fixedly mounted on the wall, and securing the bottom margin of the interposed panel to the wall (in overlapping relation to the top margin of the lower course of panels) by engagement of its second locking means with an interlocking structure fixedly mounted on the wall. In this way, the gap between the upper and lower courses is bridged by a panel to provide a continuous array of panels each secured to the wall along both top and bottom margins, yet in a manner that avoids the need for high precision in relative positioning of the upper and lower courses.

Further features and advantages of the invention will be apparent from the detailed description hereinbelow set forth, together with the accompanying drawings.

BRIEF DESCRIPTION OF THE DRAWINGS

FIG. 1 is a front elevational view of a siding system incorporating an illustrative embodiment of the system of the invention;

FIG. 2 is an enlarged perspective view of the clip means of the embodiment of FIG. 1;

FIG. 3 is a similarly enlarged perspective view of the retaining means of the FIG. 1 embodiment;

DETAILED DESCRIPTION

Figures 4, 5, 6:
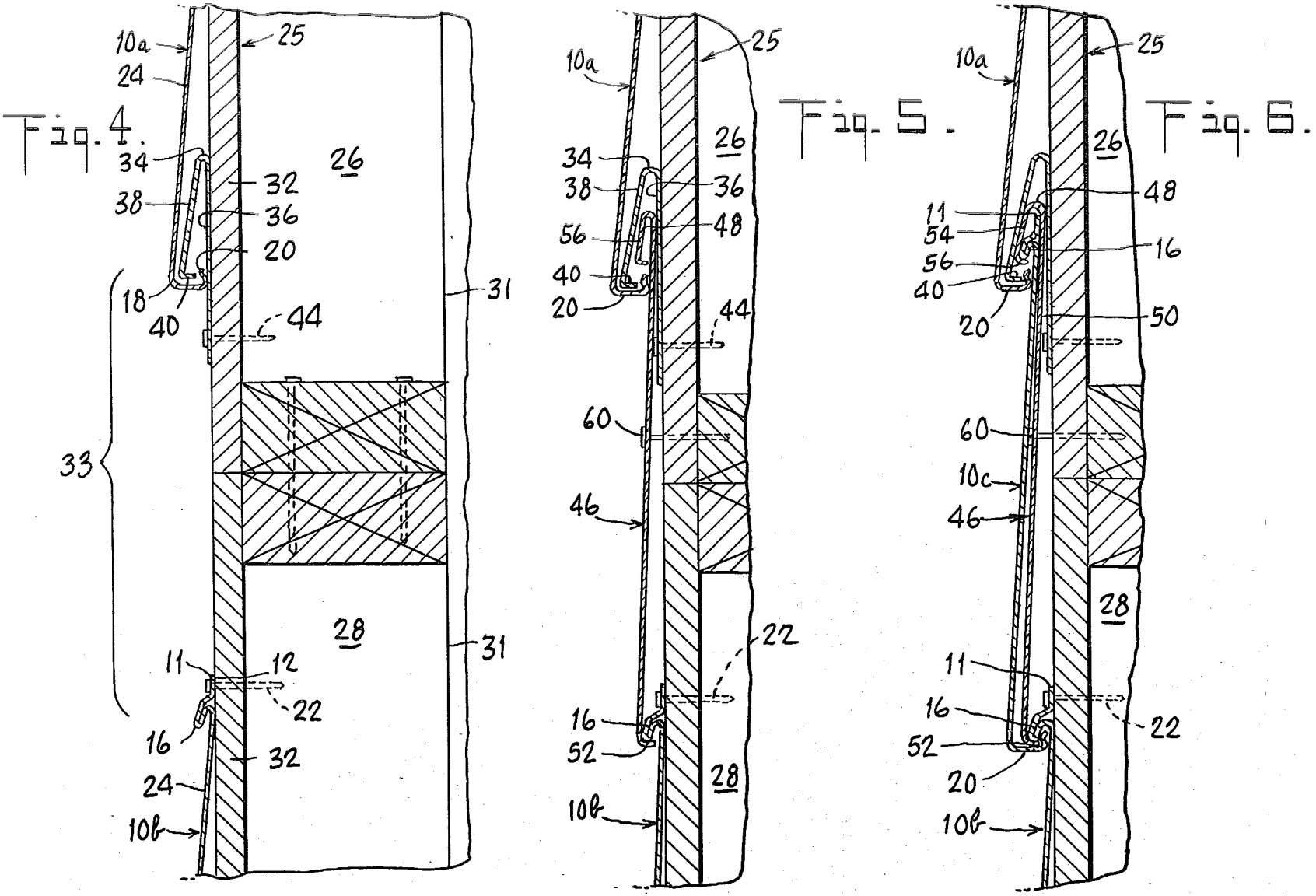
FIGS. 4, 5 and 6 are enlarged side elevational sectional views illustrating successive steps or stages in the installation of a panel in accordance with the method of the invention, using the embodiment of FIG. 1.

Referring to the drawings, the invention is illustrated and will be described as embodied in systems and methods for use with horizontally elongated, roll-formed sheet aluminum siding panels 10 of a generally conventional type such as are commonly mounted in successive parallel overlapping courses, one above another, on an exterior building wall, to clad the wall protectively and to simulate the appearance of wooden clapboards. Each of these panels 10 has a top margin 11 including a nailing flange portion 12 perforated at horizontally spaced intervals by nail holes 14 and an outwardly and downwardly projecting bead or lip 16 formed immediately below the nailing flange. In addition, each panel 10 has a bottom margin 18 formed into an inwardly projecting, upwardly opening channel flange 20. The lip 16 and channel flange 20, both of which extend along at least substantially the full horizontal length of the panel, respectively constitute complementary first and second locking means for interlocking vertically adjacent panel courses when the panels are mounted in conventional manner on a wall.

In such conventional mounting of the panels, each course of panels is secured to a wall by driving nails 22 into the wall through holes 14 of the nailing flanges. The panels of the next higher course are then so positioned on the wall that their bottom margins overlap the top margins of the already-nailed course of panels, with the lips 16 of the latter panels received in the channel flanges 20 of the higher-course panels, and the top margins of the higher-course panels are nailed in turn to the wall, this operation being repeated for successively higher courses until the wall is fully covered by the panels. Each panel in the thus-mounted array is fixed to the wall at its top margin by the nails driven therethrough, and at its bottom margin by the interlocking engagement of its second locking means or channel flange 20 with the first locking means or lip 16 of a panel or panels of the next lower course; the major surface 24 of each panel slopes downwardly and outwardly from the lip to the bottom margin of the panel. Typical or exemplary dimensions of the panels are 8 inches in panel height and up to 12 feet in horizontal length, all the panels of a given array being ordinarily essentially identical in height.

To illustrate a particular environment of use for which the advantages of the invention are important, there is shown (in FIGS. 1, 4–6, 7 and 8) a vertical exterior building wall 25 comprising upper and lower prefabricated wall sections respectively designated 26 and 28 disposed one above another, and fixedly secured together at a joint 30, with their outer surfaces in a common plane. Each wall section is a factory-assembled frame of studs 31 and exterior wooden sheathing 32. Mounted on the sheathing of each section is a partial array of the panels 10; these panels are installed by the manufacturer of the prefabricated sections in such manner that when the sections are joined together at a building site, the panels mounted on the upper section 26 are parallel to the panels on the lower section 28 but a vertical space or gap 33 is left between the top course of panels on the lower section and the bottom course of panels on the upper section. The bottom course of panels on the upper wall section will hereinafter be designated the upper course 10*a*, and the top course of panels on the lower wall section will be designated the lower course 10*b*.

The existence of a gap 33 in the panel array at the joint 33 is dictated by the fact that the height of the lower wall section is usually not an integral multiple of the height of one panel, and also by the practical impossibility of interlocking pre-installed upper and lower courses of panels at the joint 30 when the wall sections are joined together, i.e. even if the panels of those courses were positioned to meet at the joint. For both protective and aesthetic reasons, this gap 33 must be bridged (thereby to cover the joint 30) at the building site after the wall sections are assembled. Ordinarily, however, it is not possible to bridge the gap by simply simultaneously interlocking the lip 16 and channel flange 20 of an interposed course of the panels 10 with the channel flange and lip, respectively, of the upper and lower course panels, because inaccuracies of stud wall construction (e.g. owing to variation of stud sizes or placement of components) prevent reliable provision of a gap height within the close tolerances required for such simultaneous interlocking.

The present invention, in its embodiments now to be described, provides systems and methods for mounting an interposed course 10*c* of the panels 10 between the vertically spaced, already-installed upper and lower courses 10*a* and 10*b*, for example in a prefabricated wall construction of the type referred to above.

For the practice of the invention, the pre-installed upper course 10*a* and lower course 10*b* of panels are so positioned on their respective wall sections that, when the wall sections are secured together, the height of the gap 33 (between the channel flanges 20 of the upper-course panels and the lips 16 of the lower-course panels) is less than the height (between lip 16 and channel flange 20) of the panels of the course 10*c* which is to be interposed in the gap. Within this limit, however, the present invention accommodates substantial variation in gap height, such as may be caused by the aforementioned variations in stud wall construction. Thus, for example, with an interposed panel height of 8 inches, the height of the gap 33 may be anywhere from about 7 to about $7\frac{3}{4}$ inches. It is relatively easy for the prefabricated wall manufacturer to assure that the gap height will be within such a range.

Referring now more particularly to FIGS. 1–6, the system of the invention in the specific embodiment there shown includes clip means comprising a plurality of first clips 34 fixedly mountable on the upper wall section 26 for interlocking with the channel flanges 20 of the panels of the upper course 10*a* to secure the bottom margin of the upper-course panels to the wall section 26. As best seen in FIG. 2, each of these clips 34 is a unitary strip of relatively heavy gauge, stiffly resilient sheet metal bent (transversely of its long dimension) at a central locality to provide a first, vertical leg 36 and a second leg 38 extending outwardly and downwardly from the upper extremity of leg 36 at an acute angle thereto, with the lower extremity of the second leg 38 bent inwardly (toward the first leg 36) to provide a horizontal locking flange 40. The first leg 36 is substantially longer than the second leg 38, so that a portion 36*a* of leg 36 is exposed below leg 38; at least one nail hole 42 is provided in this exposed portion 36*a*.

In use, the clips 34 are mounted (by nails 44 driven through the holes 42) on the outer surface of the sheathing 32 of the upper wall section 26, adjacent the bottom margin of the wall section 26, with their locking flanges 40 horizontally aligned. The locking flanges 40 are dimensioned to be received in, and to interlock with, the channel flanges 20 of the upper-course panels 10*a* (see FIG. 4), thereby to secure the bottom margins of the upper-course panels to the wall section, with the lower portions of the latter panels overlying and concealing the clip legs 38.

As hereinafter further explained, the length of the leg 38 of each clip 34 is sufficient to enable the top marginal portion of an interposed panel 10*c* to be located, in the space between clip legs 36 and 38, at any of a range of levels above the elevation at which the lip 16 of that panel 10*c* would interlock with the channel flange 20 of an upper-course panel 10*a*, i.e. assuming the latter channel flange to be interlocked with the locking flange 40 of the clip. That is to say, the vertical dimension of the space between legs 36 and 38 above the level of flange 40 is sufficient to accommodate, without interference, the top margin of a panel 10*c* through the aforementioned range of elevations.

The system of FIGS. 1–6 also includes retaining means comprising a plurality of second clips 46 fixedly mountable on the wall 25 and each having a portion 48 for engaging the lip 16 of an interposed panel 10*c* so as to hold the lip against downward movement and to secure the top margin of the interposed panel to the wall. As shown in FIG. 3, each of the second clips 46 is a strip of relatively heavy gauge, stiffly resilient sheet metal, having a long vertical leg 50 bent inwardly at its lower end to provide a short locating flange 52 and formed at its upper end to provide the lip-engaging portion 48, which includes a relatively short leg 54 projecting downwardly and outwardly from the upper extremity of the leg 50, and a short locking flange 56 formed by an inward bend of the lower extremity of the leg 54. The portion 48 is so shaped and dimensioned that, when the top margin of an interposed panel 10*c* is inserted upwardly therein, the lip 16 of the panel bears against the upwardly facing surface of the locking flange 56 and the panel top margin is accommodated without interference above the flange 56, between the legs 50 and 54.

The length of the long vertical leg 50 is such that, when the lip 16 of a panel 10*c* bears against the upper surface of the locking flange, the locating flange 52 is fully received within the channel flange 20 at the bottom margin of that panel 10*c* (see FIG. 6); i.e. the vertical spacing of flanges 52 and 56 is essentially equal to the panel height of the panel 10*c*. In the portion 50*a* of leg 50 extending below the leg 54, one or more nail holes 58 are provided, through which nails 60 are driven to secure the clip 46 to the wall 25 (FIG. 5).

The system of FIGS. 1–6 may be considered as also including means for interlocking with the channel flanges 20 of the interposed panel 10*c* to secure the bottom margins of the interposed panels to the wall. This last-mentioned interlocking means, in the illustrated embodiment, comprises the lips 16 of the lower-course panels 10*b*.

The use of the above-described system in the practice of an illustrative embodiment of the method of the invention may now be readily explained with particular reference to FIGS. 4–6. It will be understood that the panels 10 (other than the interposed course 10*c*) are installed on the prefabricated wall sections 26 and 28 by the manufacturer of the wall sections, i.e. at the factory, in what may be a generally conventional manner except that the bottom margins of the panels of the upper course 10*a* are secured to the wall section 26 by nailing the clips 34 to the sheathing 32 of that wall section adjacent the bottom edge thereof and interlocking the channel flanges 20 of the panels of course 10*a* with the locking flanges 40 of the clips. The location of the clips 34 on the wall section 26 is selected, with reference to the location of the lips 16 of the lower-course panels 10*b* relative to the top edge of wall section 28, so that when the prefabricated wall sections are joined together to constitute the wall 25 at a building site, the vertical height of the gap 33 between the lips 16 of the lower course 10*b* of panels and the channel flanges 20 of the upper course 10*a* of panels will be somewhat less than the panel height of the interposed course 10*c*.

After the wall sections are joined together at a building site as shown in FIG. 4, with the clips 34 and the upper course 10*a* and lower course 10*b* mounted on the assembled wall as illustrated, the clips 46 are installed at horizontally spaced locations along the gap 33. To install each clip 46, the engaging portion 48 thereof is inserted upwardly behind the bottom margin of an upper-course panel 10*a* and between the legs 38 and 36 of one of the clips 34 until the locating flange 52 of that clip 46 engages the lip 16 of a lower-course panel 10*b*; and the clip 46, thus positioned, is then fixedly secured to the wall by one or more nails 60 (FIG. 5). Because the vertical legs 50 of the clips 46 project below the upper course panels, they can be nailed to the wall without difficulty notwithstanding that the upper-course panels are installed prior to mounting of the clips 46. The length of the leg 38 of each clip 34 is substantially greater than the vertical height of the engaging portion 48 of a clip 46 (i.e. measured from locking flange 54 to the top of the portion 48) and is thus sufficient to accommodate the engaging portion 48 of a clip 46 (without interference) between legs 38 and 36 through a range of levels at which the locking flange 56 of the clip 46 is disposed above the locking flange 40 of the clip 34. The locating flange 52 of each clip 46 serves as a means for positioning the locking flange 56 at a distance above the lip 16 of a subjacent lower-course panel 10*b* equal to the panel height of a panel 10*c* to be interposed between the upper and lower courses. Since the height of the gap 33 is less than the panel height, the locking flange 56 of a clip 46 will be some distance above the locking flange 40 of the clip 34 in which it is inserted when the clip 46 reaches the above-described position determined by the locating flange 52 and is nailed to the wall.

Once the clips 46 are mounted on the wall, the interposed course of panels 10*c* can be installed. The top margin 11 of each panel 10*c* is inserted vertically upward behind the bottom margin of an upper-course panel 10*a*, between the legs 38 and 36 of the clips 34, and between the legs 54 and 50 of the clips 46, until the lip 16 of the interposed panel passes above the locking flange 56. The spacing between the locking flange 56 and the leg 50 in the unstressed condition of the engaging portion 48 is less than that required for such upward passage of the lip 16; but owing to the resiliency of the clip 46 and the downwardly sloping shape of the lip, the leg 54 yields outwardly as the lip moves upwardly and then snaps back as soon as the lip passes above the flange 56, thereby locking the lip in place (bearing against the upper surface of flange 56) against downward movement, as shown in FIG. 6.

As the top margin of a panel 10*c* is being thus inserted in the engaging portions 48 of the clips 46, the bottom margin of the panel is guided by the installer along the outer surface of the subjacent lower-course panel 10*b*. Because of the described positioning of the clips 46, when the lip 16 of the panel 10*c* interlocks with the engaging portions of the latter clips, the channel flange of that panel 10*c* simultaneously interlocks with the lip 16 of the lower-course panel 10*b* (as also shown in FIG. 6), the top margin 11 of which has already been nailed to the wall at the factory. The lip 16 of the panel 10*b* then prevents further upward movement of the panel 10*c*.

In this way, with a manipulatively simple upward installing movement, each panel of the interposed course 10*c* becomes fixedly secured to the wall along both its top and bottom margins, with its lip 16 positioned (and held by the engaging portions of the clips 46) at a location behind the panels 10*a* and above the elevation at which the lip would interlock with the channel flange 20 of the adjacent upper-course panel 10*a*. The thus-installed panels of the interposed course 10*c* bridge the gap 33, with their top margins overlapped by the upper-course panels 10*a* and their bottom margins overlapping the lower-course panels 10*b* so as to provide, in cooperation with the previously installed panels on the wall sections 26 and 28, a continuous, overlapping array of panels extending without interruption over the joint 30 between the wall sections. Although the exposed height of the interposed panels is slightly less than that of the other panels of the array, the difference in exposed heights is not objectionably noticeable; yet (because one margin of the interposed panels is not interlocked directly with an adjacent panel course and, more particularly, in the described embodiment, because the clips 46 are positionable throughout a range of elevations relative to the upper-course panels) the invention accommodates a practicably broad range in spacing between the upper and lower courses 10*a* and 10*b* resulting from variations in stud wall construction. The lips 16 of the interposed panels 10*c* are concealed behind the upper-course panels 10*a*, and the upper-course panels and interposed panels together fully conceal the clips 34 and 46 as well as the lips 16 of the lower-course panels 10*b*.

It is commonly preferable to position both the clips 34 and the clips 46 at the locations of vertical studs of the wall sections, to provide a secure footing for the nails that fasten them to the wall. Accordingly, they are shown in FIGS. 1 and 4–6 as positioned in coincident or superimposed relation, i.e. with each clip 46 overlying a clip 34. Such positional coincidence is not essential, however; for example, if the sheathing 32 is sufficiently heavy to obviate nailing into the studs, the clips 46 could be positioned at locations intermediate the clips 34. In addition, the separate clips 34 could be replaced by a continuous metal strip of like profile, as indeed could the clips 46; but to save metal, use of separate small clips is ordinarily preferred.

As already described, the portion 48 of each clip 46 is, in effect, a spring clip, its outer leg 54 having a free lower extremity and being resiliently displaceable to enable upward insertion of a lip 16 of a panel 10*c* and to lock the lip in place against downward movement after the lip is inserted. Similarly, each of the clips 34 is a spring clip; the spacing between its locking flange 40 and vertical leg 36 in the unstressed condition of the clips is less than that required for upward insertion of the clip 46 and/or of the panel 10*c* therebetween, i.e. when the channel flange 20 of an upper-course panel 10*a* is interlocked with the flange 40, but the clip leg 38 (which also has a free lower extremity) yields outwardly to permit such insertion and then, being resilient, leg 38 returns so that there is no undesired gap between the channel flange of a panel 10*a* and the adjacent surface portions of a panel 10*c*.

Figure 9:
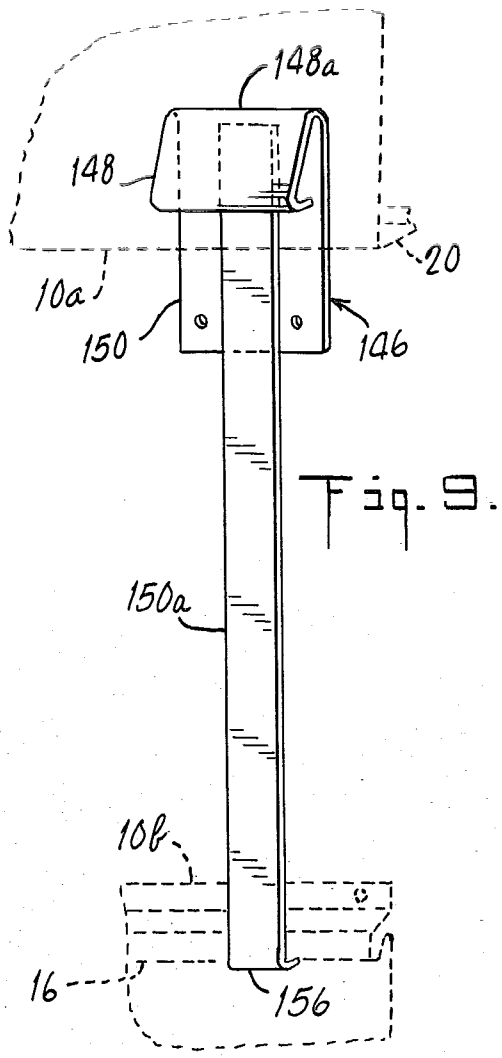
FIG. 9 is a view, similar to FIG. 3, of the retaining means of the embodiment of FIGS. 7–8.
Figure 8:
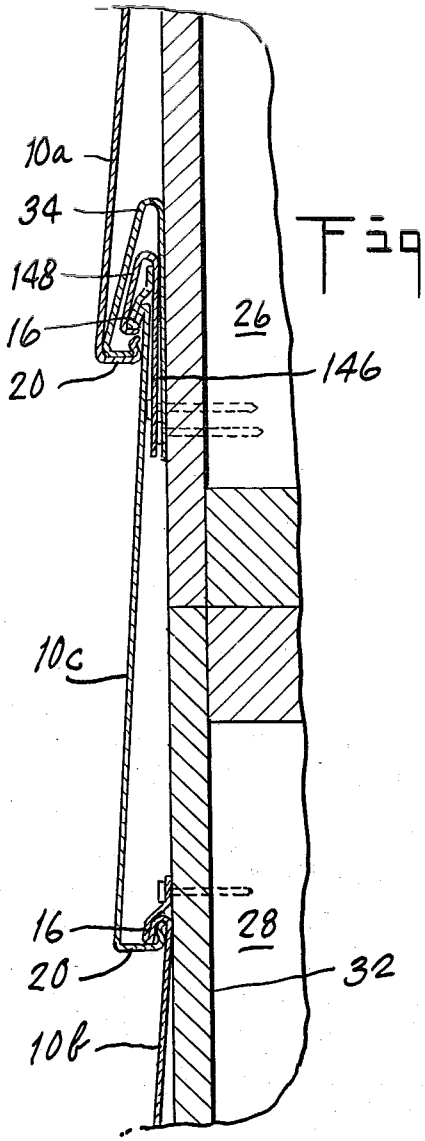
FIGS. 7 and 8 are views similar to FIGS. 5 and 6, illustrating another embodiment of the system of the invention during successive steps of installation of a panel in accordance with the method of the invention.
Figure 7:
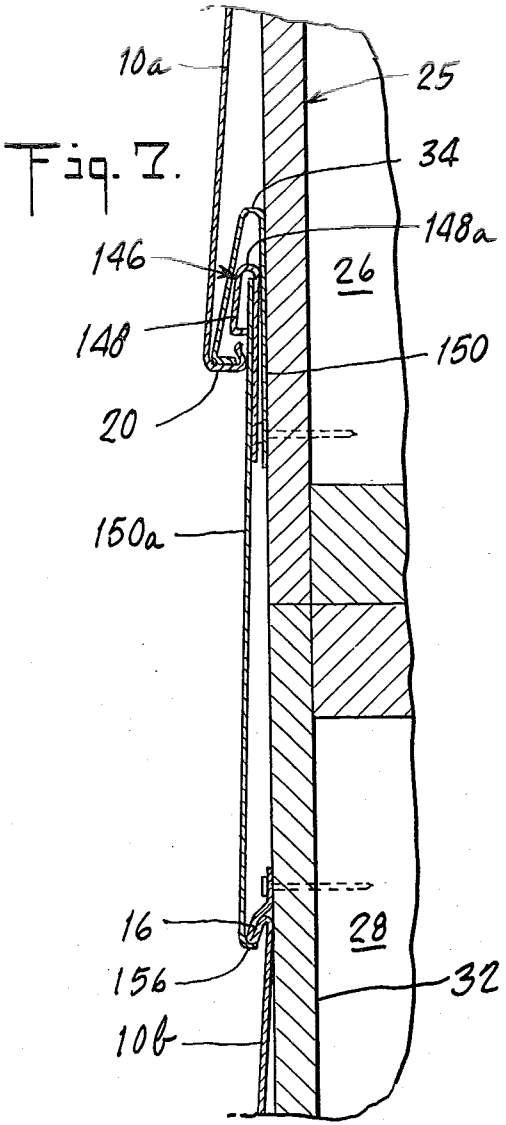

A modified form of retaining means is illustrated in FIGS. 7–9, wherein the structure and arrangement of all other elements (panels 10, clips 34, and wall sections 26 and 28) are the same as in FIGS. 1–6. The retaining means of FIGS. 7–9 comprises a plurality of clips 146, each formed of a unitary strip of metal and including a vertical leg 150 shaped at its upper end to provide an engaging portion 148 identical to the portion 48 of the clips 46 described above. The leg 150 of each clip 146, however, extends downwardly below the portion 148 only sufficiently to enable the clip to be readily nailed to the wall when the portion 148 is inserted behind the bottom margin of an upper-course panel 10*a*. A positioning guide 150*a* (FIG. 9), which is an elongated straight strip of metal having a locating flange 156 formed at its lower end, serves as the positioning means of the retaining means, i.e. to position each clip 146 at the proper elevation. The vertical length of the guide 150*a* is such that, when its upper end engages the top bend 148*a* of the portion 148 of a clip 146, and its flange 156 engages the lip 16 of a lower-course panel 10*b* (FIG. 7), the portion 148 will be disposed to hold the lip 16 of an interposed panel 10*c* at the correct elevation for interlocking of the interposed panel channel flange with the lip of the lower-course panel (FIG. 8). After being properly located, each clip 146 is nailed to the wall prior to installation of the panels 10*c*. Since one guide 150*a* can be used to position all the clips 146 used in an installation, there is a saving in metal required for the vertical legs of the clips 146 as compared with the clips 46 of FIGS. 1–6.

It is to be understood that this invention is not limited to the features and embodiments hereinabove specifically set forth, but may be carried out in other ways without departure from its spirit.

I claim:

1. A system for mounting, on a wall, a horizontally elongated siding panel in interposed relation to vertically spaced upper and lower courses of like panels already secured to the wall, said siding panels being of a type that are disposed one above another on a wall in parallel, overlapping array, each of said panels having a top margin along which it is attached to the wall, a bottom margin, and complementary first and second locking means respectively adjacent said top and bottom margins for interlocking vertically adjacent overlapping panels by engagement of the first locking means of one overlapped panel with the second locking means of an overlapping panel immediately above it in the array, the vertical distance between the second locking means of said upper course and the first locking means of said lower course being less than the vertical distance between the first and second locking means of said interposed panel, said system comprising (a) clip means fixedly mountable on the wall for interlocking with the second locking means of a panel of said upper course to secure the bottom margin of the upper-course panel to the wall; and (b) retaining means securable to the wall and having a portion for engaging the first locking means of the interposed panel, at a location behind the last-mentioned upper-course panel and above the elevation at which the first locking means of the interposed panel would interlockingly engage the second locking means of said last-mentioned upper-course panel, to hold the first locking means of the interposed panel against downward movement below said location and to secure the top margin of the interposed panel to the wall, with said clip means and said retaining means both concealed behind the upper-course and interposed panels, (c) said clip means being shaped and dimensioned to permit the top margin of the interposed panel to be inserted upwardly behind the last-mentioned upper-course panel at least sufficiently to position the first locking means of the interposed panel at said location.

2. A system as defined in claim 1, further including means for interlocking with the second locking means of the interposed panel, when the first locking means engages said portion of said retaining means at said location, to secure the bottom margin of the interposed panel to the wall.

3. A system as defined in claim 2, wherein said last-mentioned interlocking means comprises the first locking means of a panel of said lower course.

4. A system as defined in claim 3, wherein said retaining means further includes means for positioning the engaging portion of said retaining means at a height, above said first locking means of said lower-course panel, equal to the distance between the first and second locking means of the interposed panel.

5. A system as defined in claim 3, wherein said clip means permits the top margin of the interposed panel to be inserted upwardly as aforesaid, without interference, through a range of elevations above the elevation at which the first locking means of the interposed panel would interlockingly engage the second locking means of said last-mentioned upper-course panel.

6. A system as defined in claim 5, wherein said second locking means of each panel comprises an inwardly and upwardly opening channel flange, and wherein said clip means comprises a plurality of spring clips mountable in horizontally spaced relation to each other on the wall and each including a first leg securable to the wall and a second leg projecting outwardly and downwardly from the first leg with a free lower extremity receivable within the channel flange of the last-mentioned upper-course panel.

7. A system as defined in claim 6, wherein said first locking means of each panel comprises an outwardly and downwardly projecting longitudinal lip, and wherein said retaining means comprises a plurality of spring clips mountable in horizontally spaced relation to each other on the wall and each including an engaging portion for receiving and retaining the top margin of the interposed panel including said lip and a vertical leg, securable to the wall, having a length sufficient to extend below the last-mentioned upper-course panel when the engaging portion is positioned to receive the top margin of the interposed panel at said location.

8. A system as defined in claim 2, wherein at least one of said last-mentioned interlocking means and said retaining means prevents upward displacement of the interposed panel above a position at which the first locking means of the interposed panel is at said location.

9. A system as defined in claim 8, wherein at least one of said last-mentioned interlocking means and said retaining means is selectively positionable throughout a range of elevations relative to the first locking means of said lower-course panel.

10. A siding panel assembly mounted on a wall and comprising, in combination, (a) a plurality of courses of horizontally elongated siding panels secured to the wall, said siding panels being disposed one above another on the wall in parallel, overlapping array, each of said panels having a top margin along which it is attached to the wall, a bottom margin, and complementary first and second locking means respectively adjacent said top and bottom margins for interlocking vertically adjacent overlapping panels by engagement of the first locking means of one overlapped panel with the second locking means of an overlapping panel immediately above it in the array, said assembly including vertically spaced upper and lower courses of the panels and at least one other panel interposed between the upper and lower courses, the vertical distance between the second locking means of said upper course and the first locking means of said lower course being less than the vertical distance between the first and second locking means of said interposed panel;

(b) clip means fixedly mounted on the wall and interlocked with the second locking means of a panel of said upper course for securing the bottom margin of the upper-course panel to the wall; and (c) retaining means secured to the wall and having a portion engaging the first locking means of the interposed panel, at a location behind the last-mentioned upper-course panel and above the elevation at which the first locking means of the interposed panel would interlockingly engage the second locking means of said last-mentioned upper-course panel, for holding the first locking means of the interposed panel against downward movement below said location and to secure the top margin of the interposed panel to the wall, with said clip means and said retaining means both concealed behind the upper-course and interposed panels, (d) said clip means being shaped and dimensioned to permit the top margin of the interposed panel to be inserted upwardly behind the last-mentioned upper-course panel at least sufficiently to position the first locking means of the interposed panel at said location.

11. An assembly as defined in claim 10, further including means interlocked with the second locking means of the interposed panel for securing the bottom margin of the interposed panel to the wall.

12. An assembly as defined in claim 11, wherein said last-mentioned interlocking means comprises the first locking means of a panel of said lower course.

13. A method of mounting, on a wall, a horizontally elongated siding panel in interposed relation to vertically spaced upper and lower courses of like panels already secured to the wall, said siding panels being of a type that are disposed one above another on a wall in parallel, overlapping array, each of said panels having a top margin along which it is attached to the wall, a bottom margin, and complementary first and second locking means respectively adjacent said top and bottom margins for interlocking vertically adjacent overlapping panels by engagement of the first locking means of one overlapped panel with the second locking means of an overlapping panel immediately above it in the array, the vertical distance between the second locking means of said upper course and the first locking means of said lower course being less than the vertical distance between the first and second locking means of said interposed panel, said method comprising the steps of (a) inserting the top margin of the interposed panel upwardly behind the bottom margin of the upper panel course until the first locking means of the interposed panel reaches a predetermined elevation higher than that at which it would interlock with the second locking means of the upper course of panels, (b) fixedly securing the interposed panel to the wall at that elevation by engagement of the first locking means thereof with a retainer structure fixedly mounted on the wall, and (c) securing the bottom margin of the interposed panel to the wall, in overlapping relation to the top margin of the lower course of panels, by engagement of the second locking means of the interposed panel with an interlocking structure fixedly mounted on the wall.

14. A method according to claim 13, wherein the securing step comprises interlocking the second locking means of the interposed panel with the first locking means of a panel of said lower course.

15. A method according to claim 14, further including the step of positioning and mounting the retainer structure on the wall at a location for engaging the first locking means of the interposed panel at a height, above the first locking means of said lower-course panel, equal to the distance between the first and second locking means of the interposed panel.

* * * * *

UNITED STATES PATENT AND TRADEMARK OFFICE

CERTIFICATE OF CORRECTION

PATENT NO. : 4,356,673

DATED : November 2, 1982

INVENTOR(S) : J. Lynn Gailey

It is certified that error appears in the above–identified patent and that said Letters Patent are hereby corrected as shown below:

Col. 5, line 56, "joint 33" should read --joint 30-- .

Signed and Sealed this

*Twenty-eighth* Day of *May 1985*

[SEAL]

*Attest:*

DONALD J. QUIGG

*Attesting Officer* *Acting Commissioner of Patents and Trademarks*